US005375565A

United States Patent [19]

Maxson et al.

[11] Patent Number: 5,375,565

[45] Date of Patent: Dec. 27, 1994

[54] FLAME ARRESTOR AND METHOD OF MANUFACTURE

[75] Inventors: Robert J. Maxson, Lafayette, Ind.; Aaron L. Smith, East Peoria; James C. Smith, Washington, both of Ill.

[73] Assignee: Caterpillar Inc., Peoria, Ill.

[21] Appl. No.: 168,556

[22] Filed: Dec. 16, 1993

[51] Int. Cl.[5] ..... F02B 75/18

[52] U.S. Cl. ..... 123/52 MF; 123/198 D

[58] Field of Search ..... 123/52 MF, 52 MV, 52 M, 123/198 D; 431/346; 48/192; 55/DIG. 20; 60/39.11

[56] References Cited

U.S. PATENT DOCUMENTS

| | | | |
|---|---|---|---|
| 2,152,594 | 3/1939 | Klotsch | 123/173 |
| 3,884,201 | 5/1975 | Cregan | 123/52 MV |
| 3,903,646 | 9/1975 | Norton | 48/192 |
| 3,954,092 | 5/1976 | Polaner | 123/198 D |
| 4,100,905 | 7/1978 | Nolan | 123/52 MV |
| 4,368,698 | 1/1983 | Matsuo et al. | 123/52 M |
| 4,509,466 | 4/1985 | Bernardoni et al. | 123/52 MF |
| 4,517,947 | 5/1985 | Nishikawa et al. | 123/489 |
| 4,653,439 | 3/1987 | Desai et al. | 123/52 MV |
| 4,682,576 | 7/1987 | Nakamura et al. | 123/179 |
| 4,893,591 | 1/1990 | Nelson | 123/52 MF |
| 4,975,098 | 12/1990 | Lee et al. | 48/192 |
| 5,072,704 | 12/1991 | Webb | 123/195 E |
| 5,203,296 | 4/1993 | Hart | 123/198 D |

FOREIGN PATENT DOCUMENTS 0044353 1/1982 European Pat. Off. .

*Primary Examiner*—Raymond A. Nelli
*Assistant Examiner*—M. Macy
*Attorney, Agent, or Firm*—Dennis C. Skarvan

[57] ABSTRACT

A flame arrestor is disclosed for use with an intake of an internal combustion engine, comprising a cylindrical housing defining an inlet and an outlet and a plurality of honeycombed passageways extending between the inlet and the outlet, wherein each of the plurality of honeycombed passageways has a predetermined length and a predetermined small cross-section substantially smaller than the predetermined length. The cylindrical housing is welded within a mounting bracket adapted for receipt in the intake of the internal combustion engine. The flame arrestor is particularly beneficial for use in a boosted engine in that cooling effectiveness and manufacturability are enhanced by the use of the honeycombed structure.

22 Claims, 2 Drawing Sheets

FLAME ARRESTOR AND METHOD OF MANUFACTURE

TECHNICAL FIELD

The present invention relates generally to a flame arrestor for use with the inlet of an internal combustion engine and, more particularly, to a flame arrestor for use with a boosted engine, and its method of use and manufacture.

BACKGROUND ART

Flame arresters for spark ignited internal combustion engines are generally known. Typically, the flame arrestor doubles as the air inlet for non-boosted engines and includes a circuitous flow path to minimize flame propagation back out through the air inlet. For example, disk-type flame arresters are known which include a peripheral side ambient air inlet and a bottom outlet mounted to a carburetor covering one or more top facing barrels. During an engine backfire, flames propagating upward from the barrels into the bottom outlet of the flame arrestor are squelched before exiting out through the peripheral side inlet.

In boosted internal combustion engines, such as by supercharging and/or turbocharging, it is desirable to locate a flame arrestor downstream of the boost device and associated engine manifolding to prevent high temperature gasses or flames from propagating back into and igniting gasses in the engine manifolding. Unlike flame arresters for non-boosted engines in which the operating environment is typically ambient temperature and pressure, flame arresters for boosted engines must operate in high temperature and high pressure environments as a result of the work performed on the intake air during compression. Further, in many applications, fuel-rich gasses are also present in the engine manifolding and increase the risk of explosion, despite aftercooling to reduce the boosted intake air temperature.

What is needed is a flame arrestor that prevents flame propagation from the combustion chamber in high temperature and high pressure operating environments, while still providing air to the combustion chamber intake with minimum pressure drop. Preferably, such a flame arrestor should be particularly suited to boosted internal combustion engines. In particular, the flame arrestor should be capable of preventing flame propagation into upstream engine manifolding during repeated engine backfires. Ideally, the flame arrestor should be durable and easily manufactured.

DISCLOSURE OF THE INVENTION

According to one embodiment of the present invention, a flame arrestor for use with an intake of an internal combustion engine is disclosed, comprising a cylindrical housing defining an inlet and an outlet, a plurality of honeycombed passageways extending between the inlet and the outlet, each of the plurality of honeycombed passageways having a predetermined length and a predetermined small cross-section substantially smaller than the predetermined length, and means for mounting the cylindrical housing to the intake of the internal combustion engine.

According to another embodiment of the present invention, an intake system for an internal combustion engine is disclosed, comprising a cylinder head including an intake passage and an exhaust passage in fluid communication with a combustion chamber of the internal combustion engine, a first manifold adapted for distributing a pressurized intake fuel/air mixture to the intake passage, means for supplying the pressurized intake fuel/air mixture to the first manifold, and a flame arrestor disposed between the first manifold and the intake passage, the flame arrestor including a plurality of honeycombed passageways adapted for flowing the pressurized intake fuel/air mixture from the first manifold to the intake passage and for preventing flame propagation from the intake passage igniting the pressurized intake fuel/air mixture in the first manifold.

According to another embodiment of the present invention, a method of manufacture of a flame arrestor for use with an intake of an internal combustion engine is disclosed, the method of manufacture comprising the steps of obtaining a honeycombed insert having a predetermined length and defining a plurality of honeycombed passageways each having a predetermined small cross-section substantially smaller than the predetermined length, attaching the honeycombed insert within a cylindrical housing to form a cylindrical metal monolith, and attaching the cylindrical metal monolith to a mounting bracket adapted for mounting to the intake of the internal combustion engine.

According to another embodiment of the present invention, a method for arresting flames propagating from an intake of an internal combustion engine is disclosed, the method comprising the steps of obtaining a honeycombed insert having a predetermined length and defining a plurality of honeycombed passageways each having a predetermined small cross-section substantially smaller than the predetermined length, attaching the honeycombed insert within a cylindrical housing to form a cylindrical metal monolith, and mounting the cylindrical metal monolith to the intake of the internal combustion engine.

BEST MODE FOR CARRYING OUT THE INVENTION

Figure 1:
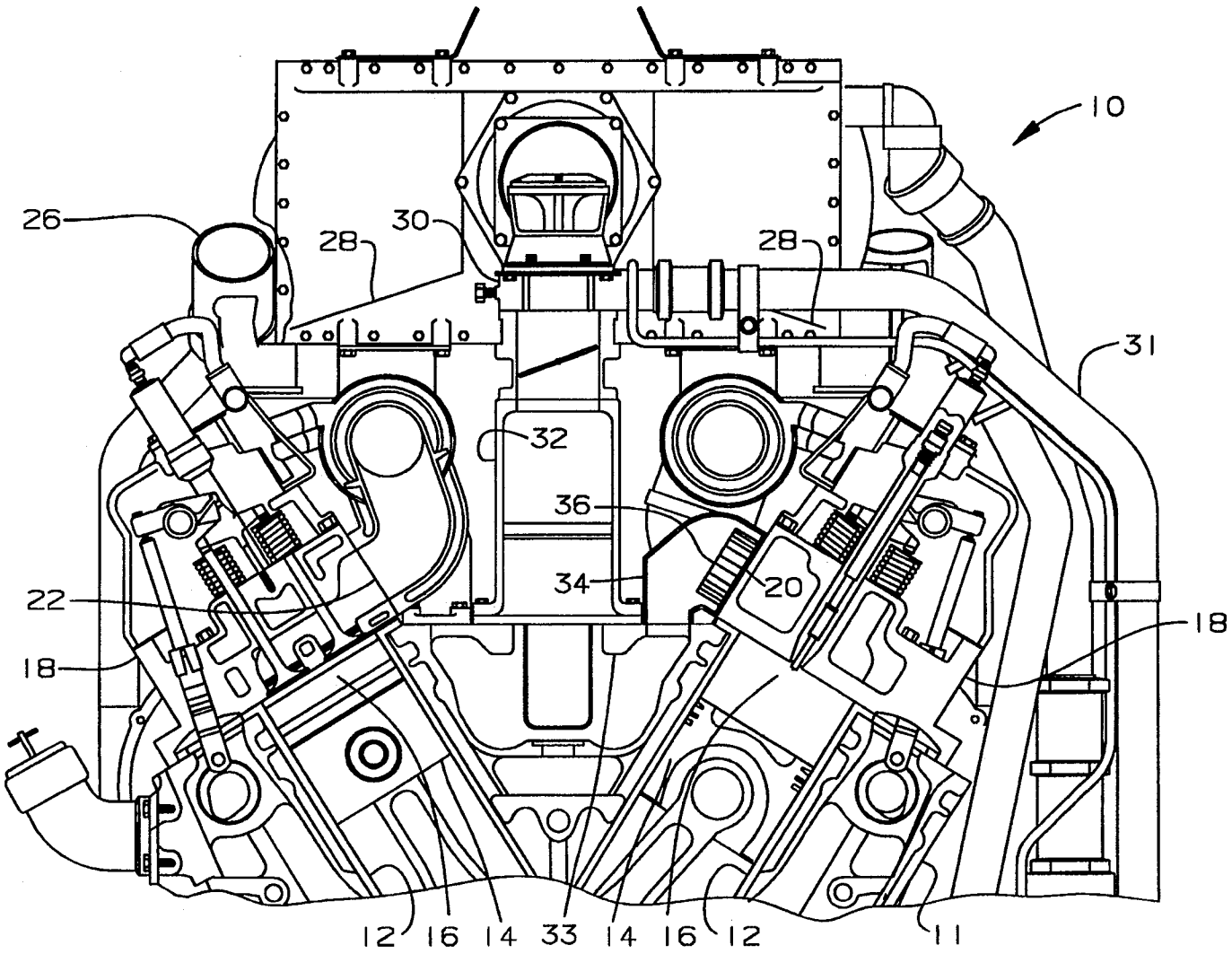
FIG. 1 is a side cross-sectional view of a turbocharged spark ignited engine including a flame arrestor mounted downstream of a turbocharger according to one embodiment of the present invention.

Referring now to FIG. 1, an internal combustion engine 10 is shown according to one embodiment of the present invention. In particular, engine 10 includes a V-type engine block 11 having banks of cylinders 12 and pistons 14 defining combustion chambers 16 therein. Cylinder heads 18 mount to block 11 and include intake passages 20 and exhaust passages 22 for communicating intake air to and exhaust gasses from combustion chambers 16, respectively.

Although the present invention is beneficial to both ambient intake (non-boosted) and boosted engines, according to the preferred embodiment engine 10 is boosted to provide pressurized or charged intake air to combustion chambers 16. Preferably, turbochargers deriving energy from exhaust gasses received from exhaust passage 22, as indicated by the direction of the arrow, compress ambient air received by an air inlet and supply charged air to the engine at 26. In the specific preferred embodiment, the turbochargers supply the charged or compressed air from outlet 26 to an aftercooler indicated at 28. Cooled compressed air from the aftercooler is ducted to a carburetor indicated at 30. Carburetor 30 also receives fuel via line 31 and supplies a pressurized compressed fuel/air mixture to manifolding 32, 33 and 34. Manifold 33 is defined in the 'V' of block 11 between the banks of cylinders and receives the pressurized fuel/air mixture from the carburetor via manifold 32 and supplies the pressurized fuel/air mixture to the various cylinders of each bank via manifolding 34.

Other forms of boost devices available for supplying charged intake air to engine 10 include superchargers as well as various combinations of turbochargers and/or superchargers. Also, in some applications, the available fuel pressure to the engine is below the turbocharger outlet pressure, and alternately the carburetor 30 and line 31 are disposed upstream of the turbochargers and supply an ambient fuel/air mixture to the turbochargers. In such an alternate application, the turbochargers supply a compressed fuel/air mixture to aftercooler 28. Manifold 33 receives the pressurized fuel/air mixture from the aftercooler via manifold 32 and supplies the pressurized fuel/air mixture to the various cylinders of each bank via manifolding 34.

Regardless of the particular air/fuel mixture delivery, a high temperature and high pressure fuel-rich environment is created in the upstream manifolding that is easily ignited during an engine backfire. As such, a flame arrestor is required to prevent flame propagation from the combustion chamber into the upstream manifolding. The flame arrestor operates to cool the high temperature flame and gasses by conducting heat from the flame and gasses to the surrounding structure. The amount of heat transfer effected by the flame arrestor is a function of the temperature differential between the flame and surrounding environment, the amount of surface area presented by the flame arrestor to the flame and high temperature gasses, and the thermal conductivity of the flame arrestor. Given the high temperature environment surrounding the flame arrestor in boosted engines tends to decrease heat transfer, the surface area and the thermal conductivity provided in the flame arrestor design is critical to the performance of the flame arrestor. Additionally, the performance of the boost device is dependent on the amount of pressure drop occurring across the flame arrestor.

Accordingly, the present invention provides a flame arrestor 36 that includes a plurality of honeycombed passageways for conducting heat away from high temperature gasses to cool the gasses and squelch any flames occurring during reverse flow conditions such as those occurring during engine backfire. Flame arrestor 36 is mounted across intake passage 20 of cylinder head 18 and has a preferred length that maximizes airflow therethrough during normal engine operation, as indicated by the direction of the arrows.

Figure 2:
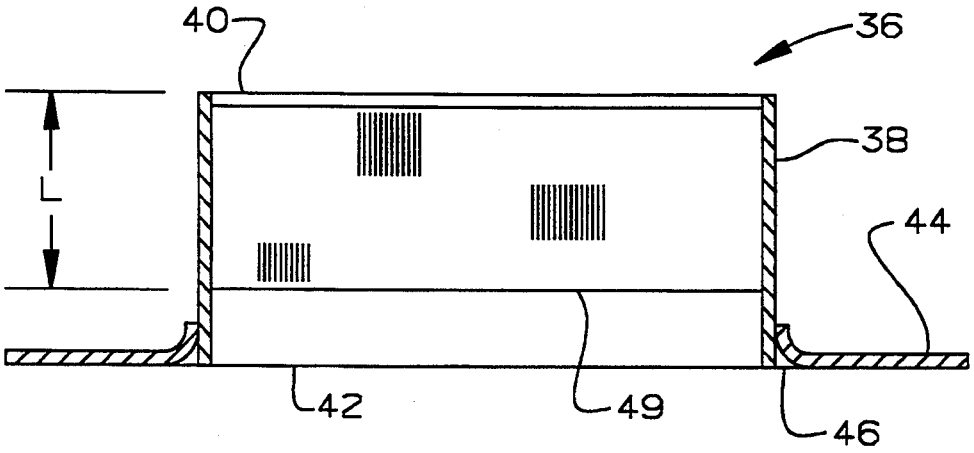
FIG. 2 is a side cross-sectional view of the flame arrestor of FIG. 1.
Figure 3:
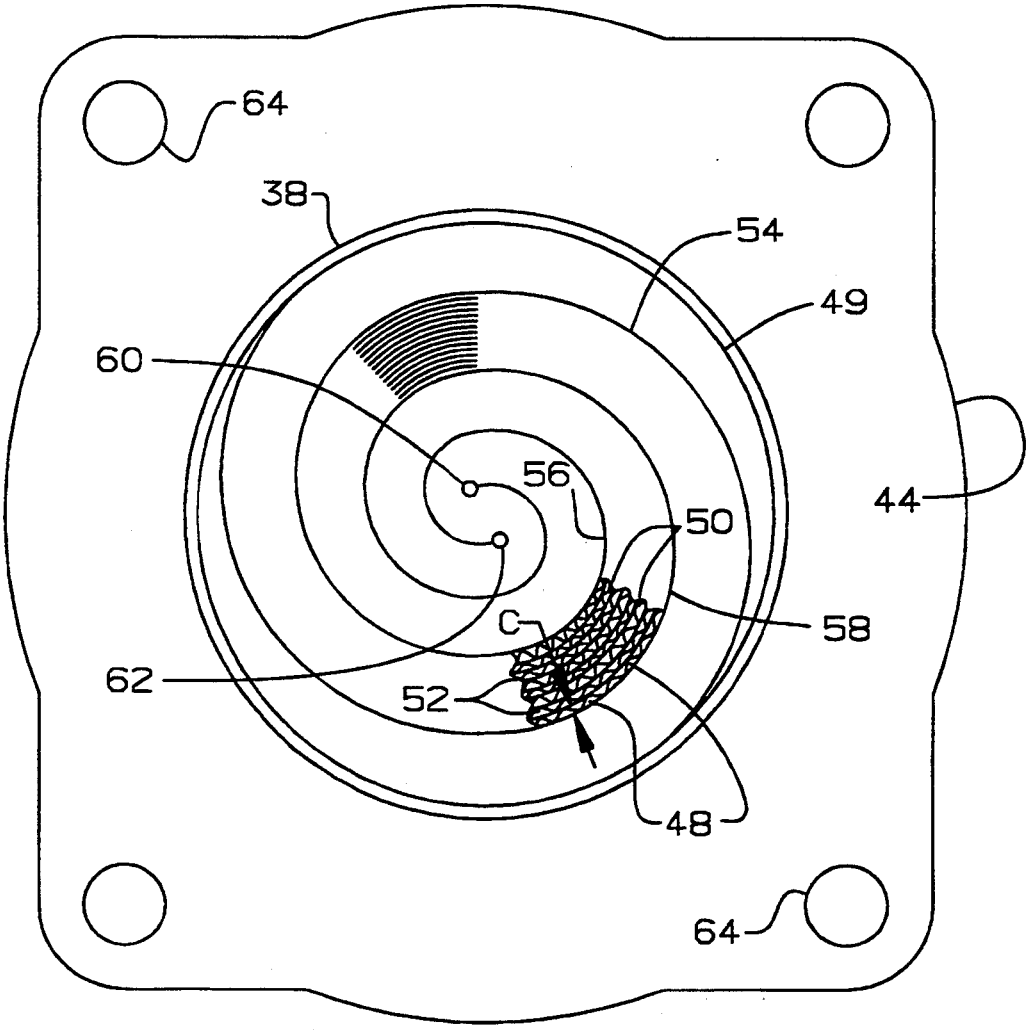
FIG. 3 is a top plan view of the flame arrestor of FIG. 1.

Referring now to FIGS. 2 and 3, flame arrestor 36 includes a cylindrical housing 38 that defines an inlet 40 at one end and an outlet 42 at an opposite end. In the preferred embodiment, mounting bracket 44 is attached adjacent to outlet 42. More specifically, outlet 42 is coincident with the mounting plane 46 defined by mounting bracket 44 so as to be near the inlet of passage 20 (as defined by a corresponding mounting surface of the cylinder head). However, other mounting bracket arrangements are also contemplated in which mounting bracket 44 is attached mid-portion to housing 38 or adjacent to inlet 40 of housing 38. For example, in one alternate embodiment, mounting bracket is attached adjacent to inlet 40 and the housing 38 is received within passage 20.

Extending across housing 38 between inlet 40 and outlet 42 are a plurality of honeycombed passageways 48. Each of passageways 48 has a predetermined length 'L' and a predetermined small cross-sectional dimension 'C' associated therewith, wherein cross-sectional dimension 'C' is substantially smaller than length 'L'. The exact ratio of dimension 'C' relative to length 'L' is a function of the heat conducting characteristics of the material chosen for passageways 48. For example, for a given length 'L', the dimension 'C' is smaller for a passageway constructed of stainless steel than for a like constructed passageway of brass. In the specific embodiment shown, flame arrestor 36 is preferably constructed of stainless steel to provide increased strength and resistance to corrosion.

For the embodiment shown, housing 38 is sized to effectively cover passage 20 and is approximately 1.378 inches in length (35 millimeters) by approximately 3.110 inches in diameter (79 millimeters). To provide the necessary surface area required for proper cooling, a honeycombed insert 49 defining passageways 48 is brazed within housing 38. Passageways 48 are constructed having a length 'L' of approximately one inch (26 millimeters) and a cross-sectional dimension 'C' of approximately 0.0787 inches (2 millimeters). For the specific embodiment shown, the cross-sectional dimension 'C' is alternately expressed in terms of "cell-density", wherein each passageway end-section presents a cell. The cell-density of the present invention is preferably in the range of about 200 to about 400 cells per square inch. A cell density of 200 cells per square inch provides adequate cooling for occasional backfires, while a cell density of 400 cells per square inch provides cooling for repeated backfires.

Preferably, passageways 48 are of a honeycombed construction to maximize the heat conducting surface area presented to the high temperature gasses flowing across the flame arrestor. In the preferred embodiment, a plurality of spiral wound corrugated sheets 50 are provided alternatingly interposed between a corresponding plurality of spiral wound planar sheets 52. In the specific preferred embodiment shown, a spiral wound laminate 54 constructed of alternating corrugated and planar sheets between top and bottom planar sheets 56 and 58, respectively, is spiral wound about corresponding pins or centers 60 and 62 to define the honeycombed insert 49.

Although a variety of honeycombed structures are contemplated for the present invention which provide sufficient conductive cooling to squelch high temperature gasses and flames, the specific preferred embodiment shown incorporating a spiral wound laminate attached within a cylindrical housing is particularly beneficial toward increasing both strength and manufacturability and reducing cost of flame arrestor 36. For example, such a spiral wound laminate is readily available from Emitec, 3300 University Dr., Auburn Hills, Mich. 48326, in the form of a cylindrical metal monolith specifically adapted for use as a substrate in a catalyst of a catalytic converter. Such a cylindrical metal monolith defines a plurality of honeycombed passageways 48 within a housing 38 and can be manufactured to the preferred length required for minimum pressure drop across the flame arrestor.

In the specific preferred embodiment shown, honeycombed insert 49 is available from Emitec as a pre-catalyst substrate at the desired length 'L' of approximately 1.0 inches (25 millimeters). Rather than forming a pre-catalyst, however, the present invention utilizes honeycombed insert 49 brazed in flame arrestor housing 38 such that housing 38 overlaps laminate insert 49 by approximately 0.3 inches (9 millimeters) and defines an overall housing length of approximately 1.3 inch (35 millimeters). The housing 38 is then welded in place within mounting bracket 44 to define flame arrestor 36. Mounting bracket 36 preferably includes pierced or machined bolt holes 64 adapted for mounting via fasteners to a corresponding mounting surface of cylinder head 18. Alternately, an off-the-shelf cylindrical metal monolith specifically adapted for use as a substrate in a catalyst of a catalytic converter, but having a length greater than the preferred length 'L', can be machined to the preferred length 'L' and than welded in place within mounting bracket 44 to define flame arrestor 36.

We claim:

1. A flame arrestor for use with an intake of an internal combustion engine, comprising:

a cylindrical housing defining an inlet and an outlet;

a plurality of honeycombed passageways extending between said inlet and said outlet, each of said plurality of honeycombed passageways having a predetermined length and a predetermined small cross-section substantially smaller than said predetermined length; and means for mounting said cylindrical housing to the intake of the internal combustion engine.

2. The flame arrestor of claim 1, wherein said cylindrical housing includes a plurality of spiral wound corrugated sheets defining said plurality of honeycombed passageways.

3. The flame arrestor of claim 2, wherein said cylindrical housing includes a plurality of spiral wound planar sheets interposed between said plurality of spiral wound corrugated sheets.

4. The flame arrestor of claim 3, wherein said cylindrical housing includes a spiral wound laminate constructed of alternating layers of corrugated sheet and planar sheet, said spiral wound laminate defining said plurality of spiral wound corrugated sheets and said plurality of spiral wound planar sheets.

5. The flame arrestor of claim 4, wherein said spiral wound laminate is brazed within said cylindrical housing.

6. The flame arrestor of claim 5, wherein said means for mounting includes a mounting bracket attached about said cylindrical housing.

7. The flame arrestor of claim 6, wherein said mounting bracket is attached adjacent to said outlet of said cylindrical housing.

8. An intake system for an internal combustion engine, comprising:

a cylinder head including an intake passage and an exhaust passage in fluid communication with a combustion chamber of the internal combustion engine;

a first manifold adapted for distributing a pressurized intake fuel/air mixture to said intake passage;

means for supplying said pressurized intake fuel/air mixture to said first manifold; and a flame arrestor disposed between said first manifold and said intake passage, said flame arrestor including a plurality of honeycombed passageways adapted for flowing said pressurized intake fuel/air mixture from said first manifold to said intake passage and for preventing flame propagation from said intake passage igniting said pressurized intake fuel/air mixture in said first manifold.

9. The intake system of claim 8, wherein said means for supplying said pressurized fuel/air mixture includes a carburetor disposed upstream of said first manifold, means for supplying fuel to said carburetor, and a boost device disposed upstream of said carburetor, said carburetor mixing pressurized air received from said boost device and fuel received from said means for supplying fuel and supplying said pressurized intake fuel/air mixture to said first manifold.

10. The intake system of claim 9, wherein said boost device includes a turbocharger driven by exhaust gasses received from said exhaust passage.

11. The intake system of claim 8, wherein said means for supplying said pressurized fuel/air mixture includes a boost device disposed upstream of said first manifold, a carburetor disposed upstream of said boost device, and means for supplying fuel to said carburetor, said carburetor mixing ambient air and fuel received from said means for supplying fuel and supplying an ambient intake fuel/air mixture to said boost device, and said boost device supplying said pressurized intake fuel/air mixture to said first manifold.

12. The intake system of claim 8, wherein said flame arrestor includes:

a cylindrical housing defining an inlet and an outlet, said plurality of honeycombed passageways extending between said inlet and said outlet, wherein each of said plurality of honeycombed passageways has a predetermined length and a predetermined small cross-section substantially smaller than said predetermined length; and means for mounting said cylindrical housing to said intake passage of said cylinder head.

13. The flame arrestor of claim 12, wherein said cylindrical housing includes a plurality of spiral wound corrugated sheets defining said plurality of honeycombed passageways.

14. The flame arrestor of claim 13, wherein said cylindrical housing includes a plurality of spiral wound planar sheets interposed between said plurality of spiral wound corrugated sheets.

15. The flame arrestor of claim 14, wherein said cylindrical housing includes a spiral wound laminate constructed of alternating layers of corrugated sheet and planar sheet, said spiral wound laminate defining said plurality of spiral wound corrugated sheets and said plurality of spiral wound planar sheets.

16. A method of manufacture of a flame arrestor for use with an intake of an internal combustion engine, the method of manufacture comprising the steps of:

obtaining a honeycombed insert having a predetermined length and defining a plurality of honeycombed passageways each having a predetermined small cross-section substantially smaller than said predetermined length;

attaching said honeycombed insert within a cylindrical housing to form a cylindrical metal monolith; and attaching said cylindrical metal monolith to a mounting bracket adapted for mounting to the intake of the internal combustion engine.

17. The method of manufacture of claim 16, wherein the steps of obtaining a honeycombed insert and attaching said honeycombed insert within a cylindrical housing includes the steps of:

spiral winding a corrugated sheet to define a spiral wound corrugated sheet; and attaching said spiral wound corrugated sheet within a cylindrical housing, said spiral wound corrugated sheet defining said plurality of honeycombed passageways.

18. The method of manufacture of claim 17, wherein the steps of obtaining a honeycombed insert and attaching said honeycombed insert within a cylindrical housing includes the steps of:

spiral winding a planar sheet adjacent to said corrugated sheet to define a spiral wound planar sheet and corrugated sheet; and attaching said spiral wound planar sheet and corrugated sheet within a cylindrical housing, said spiral wound planar sheet and corrugated sheet defining said plurality of honeycombed passageways.

19. The method of manufacture of claim 16, wherein the step of obtaining a honeycombed insert and attaching said honeycombed insert within a cylindrical housing includes the steps of:

interposing a plurality of planar sheets between a corresponding plurality of corrugated sheets to define to define a laminate;

spiral winding said laminate to define a spiral wound laminate; and attaching said spiral wound laminate within a cylindrical housing, said spiral wound laminate defining said plurality of honeycombed passageways.

20. The method of manufacture of claim 16; wherein the step of obtaining a honeycombed insert includes the step of:

obtaining a honeycombed insert adapted for use as a metal monolith substrate of a catalyst or precatalyst, said honeycombed insert defining said plurality of honeycombed passageways each having said predetermined small cross-section and said predetermined length.

21. The method of manufacture of claim 16, wherein the step of obtaining a honeycombed insert includes the step of:

obtaining a honeycombed insert adapted for use as a metal monolith substrate of a catalyst or precatalyst, said honeycombed insert defining said plurality of honeycombed passageways each having said predetermined small cross-section and a length greater than said predetermined length; and machining said honeycombed insert to said predetermined length.

22. A method for arresting flames propagating from an intake of an internal combustion engine, the method comprising the steps of:

obtaining a honeycombed insert having a predetermined length and defining a plurality of honeycombed passageways each having a predetermined small cross-section substantially smaller than said predetermined length;

attaching said honeycombed insert within a cylindrical housing to form a cylindrical metal monolith; and mounting said cylindrical metal monolith to the intake of the internal combustion engine.

* * * * *

UNITED STATES PATENT AND TRADEMARK OFFICE

CERTIFICATE OF CORRECTION

PATENT NO. : 5,375,565

DATED : December 27, 1994

INVENTOR(S) : Robert J. Maxson et al.

It is certified that error appears in the above-identified patent and that said Letters Patent is hereby corrected as shown below:

Claim 19, column 7, line 35, delete "to define" second occurrence.

Signed and Sealed this

Thirty-first Day of October 1995

*Attest:*

Bruce Lehman

BRUCE LEHMAN

*Attesting Officer*

*Commissioner of Patents and Trademarks*